United States Patent [19]

Hocfbaum, Jr.

[11] Patent Number: 5,065,648

[45] Date of Patent: Nov. 19, 1991

[54] OIL FILTER WRENCH

[76] Inventor: Gerald E. Hocfbaum, Jr., 872 Union Rd., Xenia, Ohio 45385-7212

[21] Appl. No.: 623,562

[22] Filed: Dec. 7, 1990

[51] Int. Cl.[5] ..... B25B 13/50

[52] U.S. Cl. ..... 81/64; 81/3.44; 24/279

[58] Field of Search ..... 81/64, 3.44, 487, 120, 81/65, 121.1; 24/279, 282

[56] References Cited

U.S. PATENT DOCUMENTS

| | | | |
|---|---|---|---|
| 590,710 | 9/1897 | Sheppard et al. | 81/3.44 |
| 737,404 | 8/1903 | Harrison | 81/64 |
| 1,416,673 | 5/1922 | Baldwin | 81/3.44 |
| 1,458,140 | 6/1923 | Lewis | 81/64 |
| 2,417,741 | 3/1947 | Dillon | 24/279 |

*Primary Examiner*—D. S. Meislin

*Attorney, Agent, or Firm*—Terry M. Gernstein

[57] ABSTRACT

An oil fiter wrench includes two semi-circular, semi-rigid sections, each of which includes a plurality of shark tooth-shaped projections which engage an oil filter of an internal combustion engine so that the wrench can engage the oil filter in a non-slipping manner without substantially damaging or marring that oil filter. The sections are coupled together by a hinge and by a wing nut engaging aligned threaded bores which are defined in fastener projections on each section. A wrench handle is also included which can be coupled to a further projection on the top section to add leverage to any twisting action which may be required to manipulate an oil filter. The wrench is especially useful in certain engines, particularly, in a Harley-Davidson FXR frame of the 1985 and newer model type.

8 Claims, 1 Drawing Sheet

OIL FILTER WRENCH

TECHNICAL FIELD OF THE INVENTION

The present invention relates to the general art of wrenches, and to the particular field of wrenches used in internal combustion engine work.

BACKGROUND OF THE INVENTION

Many motor vehicle owners choose to change their own oil in their vehicle. Changing oil in an internal combustion engine is generally a fairly simple task. However, one of the most onerous and vexing steps in changing the oil in an internal combustion engine is manipulating the oil filter to either remove the old filter or to place the new filter in position. The oil filters in most modern engines are often positioned in difficult-to-reach locations thus making access to the filter difficult at best. To make matters worse, many times the old filter is stuck in place and can be extremely difficult to remove, even after reaching that filter with a wrench or other tool. The position of the filter often makes manipulation of a wrench difficult so that mere removal of the filter may be difficult, let alone unsticking a stuck filter.

This overall process of removing an old filter that may be stuck in place and replacing that filter with a new filter, may require a degree of manual dexterity that may daunt a novice, and can create problems even for an experienced mechanic, especially if that mechanic has lost some dexterity in his hands as because of arthritis, injury or the like. Therefore, many people are dissuaded from changing their own oil.

For these reasons, the art has included several proposals for various wrenches which can be used to manipulate an oil filter in an internal combustion engine. While somewhat successful, these known oil filter wrenches have several drawbacks which still may inhibit easy operation thereof and easy removal and replacement of an oil filter.

For example, some oil filter wrenches require a flexible, cloth band to be wrapped around the filter and then twisted in a special manner, while others require a loop of some sort to be placed over the filter and manipulated. This may require a great deal of manual dexterity to place, secure and manipulate such loop. Still further, such wrenches are still prone to slipping even after being secured about the filter.

These problems are-especially evident in certain engines where space is quite tight. Some motorcycle engines fall into this group.

Still further, it is not desirable for an oil filter wrench to mar or damage the oil filter during a manipulation of that filter using the wrench. The inventor has found that some wrenches present the possibility of such damage and marring.

Therefore, there is a need for an oil filter wrench which is easy to secure about an in situ oil filter, even if that filter is positioned in a difficult-to-reach or tight location, and makes it easy to manipulate the secured oil filter in special engines, such as motorcycle engines, such as a Harley Davidson FXR engine, and makes it easy to place a new filter in position, yet does not raise a substantial possibility of marring or damaging the oil filter when that filter is being moved using the wrench.

OBJECTS OF THE INVENTION

It is a main object of the present invention is to provide an oil filter wrench which is easy to secure about an in situ oil filter and which is easily manipulated to place a new filter in the engine.

It is another object of the present invention to provide an oil filter wrench which can be used to manipulate a secured oil filter in a secure, non-slip manner.

It is another object of the present invention to provide an oil filter wrench which can be used in small engines, such as motorcycle engines.

It is another object of the present invention to provide an oil filter wrench which can be used to manipulate a secured oil filter in a secure, non-slip manner to place a new filter into an engine.

It is another object of the present invention to provide an oil filter wrench which can be used to manipulate a secured oil filter in a secure, non-slip manner to place a new filter into an engine yet does not raise a substantial possibility of marring or damaging the oil filter when that filter is being moved using the wrench.

It is a specific object of the present invention to provide an oil filter wrench which can be used on a Harley Davidson FXR motorcycle.

SUMMARY OF THE INVENTION

These, and other, objects are achieved by an oil filter wrench which includes two semi-rigid, semi-circular body sections that are hinged together at one end and which can be fastened together at another end by an easily operated wing nut. The wrench filter includes tooth-like projections which engage the filter and prevent the wrench from slipping as the filter is turned. The wrench further includes a handle-engaging element and a handle for manipulating the engaged filter while gaining added leverage.

The tooth-like projections are spaced, sized and oriented so that the minimum number of teeth are needed to provide a contact between the wrench and an oil filter which is secure enough to prevent significant slipping between the filter and the wrench, yet will not raise a significant possibility of damaging or marring the oil filter due to the gripping thereof by the wrench.

In this manner, it is generally easy to engage the wrench about an oil filter — no matter where that filter is positioned and no matter how tight the working area is — and the wrench will remain securely engaged with the filter as the wrench is manipulated during a filter removal or placement process, yet will not present a significant possibility of marring or damaging an oil filter due to the tight gripping thereof by the wrench. Should additional leverage be required, the handle can be used, and can be easily manipulated, even by a novice or by someone who does not have a great deal of manual dexterity.

BRIEF DESCRIPTION OF THE DRAWING FIGURES

DETAILED DESCRIPTION OF THE PREFERRED EMBODIMENT OF THE INVENTION

Figure 1:
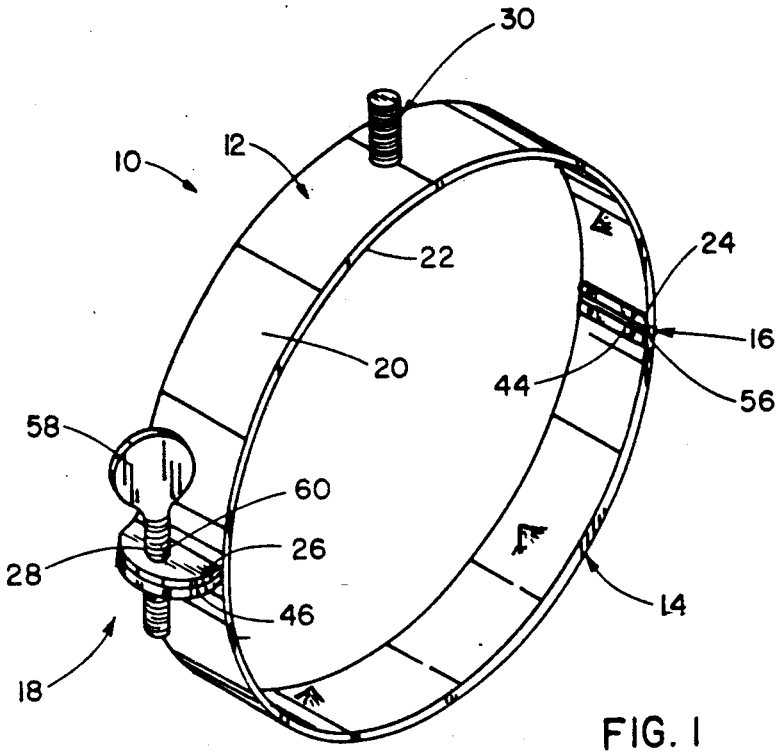
FIG. 1 is a top and front perspective view of an oil filter wrench embodying the present invention.
Figure 2:
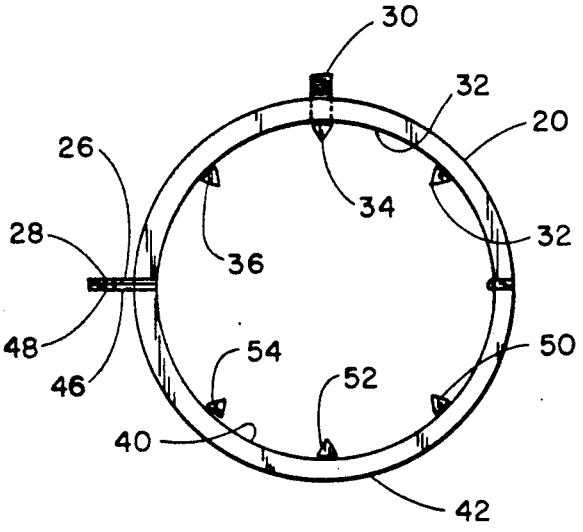
FIG. 2 is a front elevational view thereof, the rear being a mirror image of the front shown in FIG. 2.

Shown in FIGS. 1 and 2 is a clamp 10 which is used as a wrench to manipulate an oil filter in removing such oil filter from an engine and placing an oil filter on an engine. The clamp 10 is useful in conjunction with any internal combustion engine, but is especially useful in certain engines, such as the engine associated with a Harley Davidson "FXR" frame, especially of the 1985 and later designs. The clamp is easily applied to and removed form an oil filter, even if that filter is located in a difficult-to-reach position, and will remain in non-slipping contact with that oil filter as the filter is being manipulated, yet will not present a significant possibility of marring or damaging an oil filter during the manipulation thereof.

The clamp 10 includes two semi-rigid, semicircular sections, a top section 12 and a bottom section 14 which co-operate to define a circular peripheral shape. The sections can be formed of a light gage spring steel, and the semi-rigid nature of the sections permits them to flex around an oil filter, yet hold that filter in place in the clamp once the bodies are clamped together. The sections are coupled together in clam shell fashion, with a hinge unit 16 at one end and a projection unit 18 at another end of each section to be diametrically opposed to each other when the body is in the FIG. 1 closed configuration.

Specifically, the semi-circular top section has an angular extent of 180°, and includes an outer surface 20 and an inner surface 22, with a hinge element 24 on one end and a fastener projection element on the other end thereof. The fastener projection 26 extends radially outward from the outer surface of the top section and includes a bore 28 defined therethrough. The projection 26 has a screw thread defined thereon adjacent to the bore 28 for a purpose which will be understood from the ensuing discussion.

The top section further includes a screw threaded fastener element 30 mounted thereon to extend radially outwardly thereof and to be located midway between the hinge element 24 and the projection 26.

The top section further includes a plurality of shark tooth-shaped projections 32, 34 and 36 which are mounted on the inner surface 22, and extend radially inwardly of the top section. The shark tooth projections are spaced apart from each other by angular spacings of approximately 45°, with the projections 32 and 36 being spaced from the hinge element and from the projection 26 respectively by approximately 45°. The shark tooth projections engage an oil filter outer surface and hold the clamp 10 in non-slipping engagement with that oil filter as the filter is being manipulated.

The bottom section 14 is similar to the top section and thus includes an inner surface 40 and an outer surface 42 and has an angular extent of approximately 180° from one end having a hinge element 44 thereon to another end having a projection 46 thereon. The projection 46 extends radially outwardly of the bottom section and includes a bore 48 which is aligned with the bore 28 when the top and bottom sections are in the FIG. 1 and 2 closed configuration.

The bottom section further includes a plurality of shark tooth-shaped projections 50, 52 and 54 located on the inner surface 40 to extend radially inwardly of the closed clamp as shown in FIG. 2. The projections 50, 52 and 54 are angularly spaced apart by approximately 45°, and the projections 50 and 54 being spaced from the hinge element 44 and from the projection 46 respectively by an angle of approximately 45°, and the projections 50, 52 and 54 lying diametrically opposite to the projections 36, 34 and 32 respectively when the clamp is closed as shown in FIGS. 1 and 2.

The angular spacing and orientation of the shark tooth-shaped projections 32, 34, 36, 50, 52 and 54 permits the clamp to engage an oil filter in the securest possible manner with the minimum number of projections and with the minimum amount of possible marring of an oil filter. The fewer the projections, the greater the reduction in marring possibility; however, the fewer the projections, the greater the possibility of slipping during manipulation of the oil filter. Both the number of projections and the spacing and orientation thereof as shown in FIG. 2 have been selected to satisfy both of these apparently competing and opposing objectives. Furthermore, the projections should not extend more than ⅛" from the inner surfaces of the sections in order to satisfy these competing and opposing objectives.

A pintle 56 connects the hinge elements 24 and 44 to hingeably connect the top and the bottom sections together, and a wing nut 58 has a threaded section 60 that threadably co-operates with the screw threads in the aligned bores 28 and 48 to close the clamp. The wing nut can be threaded into the aligned bores until the shark tooth projections have engaged an oil filter sufficiently to ensure a non-slip connection between the clamp and the oil filter. The amount of tightening can be determined by feel and experience of the user.

Figure 3:
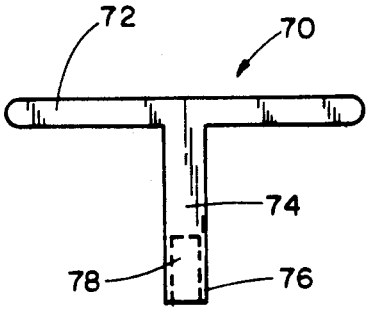
FIG. 3 is a front elevational view of a handle which can be used in conjunction with the FIG. 1 wrench to add leverage to the manipulation thereof, the rear being a mirror image of the front shown in FIG. 3.

A handle 70 is best shown in FIG. 3, and is used to gain leverage in the twisting of the clamp and an oil filter engaged therein. The handle is T-shaped and includes a hand-engaging section 72 and a neck section 74 extending from the hand-engaging section. The neck section has a distal end 76 which has a blind-ended bore 78 defined therein towards the hand-engaging section. The handle has a screw thread defined therein adjacent to the blind-ended bore, and the handle screw thread co-operates with the threaded fastener 30 to couple the handle to the clamp. Once the handle is coupled to the clamp body, the handle can be used to twist the clamp and manipulate an oil filter captured therein. Other forms of coupling between the handle and the clamp body can be used, such as an allegator type clamp in which the threaded fastener 30 is replace by a non-threaded projection, and the threaded blind-ended bore on the handle is replaced by a spring-loaded clamp, or the like can be used. The only requirement is the existence of some sort of projection similar to the threaded fastener 30 which can be grasped by a handle to couple that handle to the clamp body in a manner which permits leveraging the clamp body using the handle element.

It is understood that while certain forms of the present invention have been illustrated and described herein, it is not to be limited to the specific forms or arrangements of parts described and shown.

I claim:

1. A wrench for manipulating an oil filter comprising:

A) a circular body which includes (1) a semi-circular, semi-rigid top section having (a) an inner surface, (b) an outer surface, (c) a hinge element at one end, (d) a fastening projection at another end, said projection extending radially outward from said outer surface and having a bore defined therethrough, (e) a threaded fastener mounted on said outer surface to extend radially outward from said outer surface and being positioned midway between said hinge element and said projection, and (f) a plurality of shark tooth-shaped projections mounted on said inner surface and extending radially inward of said top section, said shark tooth-shaped projections being spaced apart from each other angularly about said top section to have approximately 45° between adjacent shark tooth-shaped projections;

(2) a semi-circular, semi-rigid bottom section having (a) an inner surface, (b) an outer surface, (c) a hinge element at one end of said bottom section and located adjacent to said top section hinge element, (d) a fastening projection at another end, said projection extending radially outward from said outer surface and having a bore defined therethrough and being located adjacent to said top section fastening projection, said fastening projection bores being positioned to be aligned with each other when said top and bottom section projections are in abutting contact with each other, (e) a plurality of shark tooth-shaped projections mounted on said bottom section inner surface and extending radially inward of said bottom section, said shark tooth-shaped projections being spaced apart from each other angularly about said bottom section to have approximately 45° between adjacent shark tooth-shaped projections on said bottom section, said bottom section shark tooth-shaped projections being diametrically opposed to corresponding top section shark tooth-shaped projections when said bottom section is closed with said top section; and B) connecting means for connecting said top section to said bottom section, said connecting means including (1) hinge connecting means pivotally connecting said top section hinge element to said bottom section hinge element, (2) a screw thread defined in said top section fastening projection adjacent to said top section fastening projection bore, (3) a screw thread defined in said bottom section fastening projection adjacent to said bottom section fastening projection bore, and (4) a threaded wing nut for threadably coupling said top section projection to said bottom section projection via said top section screw thread and said bottom section screw thread.

2. The wrench defined in claim 1 further including a handle element.

3. The wrench defined in claim 2 wherein said handle is T-shaped and includes a hand-engaging section and a neck section.

4. The wrench defined in claim 3 wherein said handle neck section has a blind-ended bore defined therein.

5. The wrench defined in claim 4 wherein said handle neck section further includes a screw thread defined therein adjacent to said blind-ended bore, said handle neck section screw thread being sized to threadably co-operate with said body top section threaded fastener to couple said handle to said body.

6. The wrench defined in claim 5 wherein said top section shark tooth-shaped projections are spaced apart from said bottom section shark tooth-shaped projections by an angular spacing of at least 45°.

7. The wrench defined in claim 6 wherein one of said top section shark tooth-shaped projections is colinearly positioned with said threaded fastener.

8. The wrench defined in claim 7 wherein said shark tooth-shaped projections extend for no more than ⅛" from the inner surface of said top and bottom sections.

* * * * *